US007487841B1

(12) United States Patent
Gonci

(10) Patent No.: US 7,487,841 B1
(45) Date of Patent: Feb. 10, 2009

(54) FIRE EXTINGUISHING SYSTEM AND FITTINGS

(76) Inventor: Kenneth A. Gonci, 6901 7th Ave. West, Bradenton, FL (US) 34209

( * ) Notice: Subject to any disclaimer, the term of this patent is extended or adjusted under 35 U.S.C. 154(b) by 516 days.

(21) Appl. No.: 11/138,713

(22) Filed: May 25, 2005

(51) Int. Cl.
*A62C 35/00* (2006.01)

(52) U.S. Cl. ..... 169/16; 169/37; 169/54; 239/208; 239/209; 239/565; 239/600; 285/179

(58) Field of Classification Search ..... 169/16, 169/37, 54; 239/208, 209, 266–268, 565, 239/600; 285/133.4, 179; 52/1, 168
See application file for complete search history.

(56) References Cited

U.S. PATENT DOCUMENTS 1,208,349 A * 12/1916 Moody ..... 239/565
2,530,001 A * 11/1950 Cowan ..... 239/208
5,609,212 A 3/1997 McHugh
5,669,449 A 9/1997 Polan et al.
5,984,015 A 11/1999 Vieregge
6,109,361 A * 8/2000 Henderson ..... 169/54
6,450,264 B1 9/2002 Christian
6,523,616 B1 2/2003 Wallace
6,540,261 B1 4/2003 Painter et al.
6,679,337 B1 * 1/2004 Perry et al. ..... 169/16
6,719,214 B1 4/2004 Shaffer
6,772,562 B1 * 8/2004 Dadamo ..... 239/209

* cited by examiner

*Primary Examiner*—Steven J Ganey
(74) *Attorney, Agent, or Firm*—Charles J. Prescott

(57) ABSTRACT

A building inside fire extinguishing system, the building having a standard roof pitch and corresponding peak angle. The system including a main water supply line extending along the base or lower margin of the roof and having spaced parallel upright pipe nipples attached to the main water supply line, a plurality of feed lines extending upwardly from the main water supply line parallel to the roof and a plurality of spaced water sprinkler heads operably attached to each of the feed lines. To interconnect the upper end of each upright nipple, an array of roof slope sprinkler fittings is provided, one of which is selected angularly matching the roof pitch. These sprinkler fittings each include an angled hollow body having a female threaded inlet and a female threaded outlet angularly oriented at different standard roof pitch angles one of which will equal the standard pitch of the roof. Each fitting is threadable directly to and between the pipe nipple and a lower end of the feed line. A separate array of roof peak fittings connecting the upper ends of each pair of aligned feed lines may also be provided.

8 Claims, 4 Drawing Sheets

50
6/12 PITCH
5/12 PITCH
4/12 PITCH
3/12 PITCH
2/12 PITCH
1/12 PITCH
50a
50b
50c
50d
50e
50f
94.76°
99.46°
104.04°
108.43°
112.62°
116.57°
F
D
K 60
6/12 PITCH
5/12 PITCH
4/12 PITCH
3/12 PITCH
2/12 PITCH
1/12 PITCH
60a
60b
60c
60d
60e
60f
63.43°
26.57°
67.38°
22.62°
71.57°
18.43°
75.96°
14.04°
80.54°
9.46°
85.24°
4.76°
J
M
F

FIRE EXTINGUISHING SYSTEM AND FITTINGS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to fire prevention sprinkler systems for buildings and warehouses and more particularly to a more economical means for installation of such systems.

2. Description of Related Art

Buildings and warehouses are required to have inside fire preventive sprinkler systems which are typically of the water dispensing type through a plurality of sprinkler heads positioned in close proximity to the inside surface of the roof for maximum effectiveness. These typical fire prevention systems include elongated main water feed lines which extend along the base or lower margin of each roof panel and include sprinkler head mechanisms attached in space relationship along pipe feed lines which extend orthogonally from each main water line upwardly alongside and in close parallel relationship to the roof.

To establish the fluid connection between the lower end of each of these feed lines and the main water supply line, a series of three fittings are required due to the fact that each roof panel is sloped at a standard pitch angle which may vary from 1:12 to 6:12 in pitch. The sprinkler system installers are typically armed only with 90° and 135° elbows and straight short nipple fittings so that, to fabricate each such joint between the feed tubes and the main water supply line, two 90° elbows and an interconnecting short straight nipple attached to an uprightly connected nipple tap into the main water line are required.

A number of prior art devices deal generally with fittings for water sprinkler systems installed into buildings and warehouses as follows:

U.S. Pat. No. 5,609,212 to McHugh

U.S. Pat. No. 5,669,449 to Polan, et al.

U.S. Pat. No. 6,540,261 to Painter

U.S. Pat. No. 6,450,264 to Christian

U.S. Pat. No. 6,523,616 to Wallace

U.S. Pat. No. 6,719,214 to Shaffer

U.S. Pat. No. 5,669,449 to Polan, et al. discloses directional sprinklers designed for optimum operation over certain ranges of pitches and are envisioned to be within about 25° of the pitches from the overhead walls under which such sprinklers are installed.

Shaffer teaches a fire-extinguishing device in U.S. Pat. No. 6,719,214 and a sprinkler system is disclosed by Christian in U.S. Pat. No. 6,450,264. Fire sprinkler piping system fittings are taught by Painter, et al. in U.S. Pat. No. 6,540,261, and a building fire extinguishing system is disclosed by Wallace in U.S. Pat. No. 6,523,616. McHugh teaches adjustable sprinkler head positioning assemblies in U.S. Pat. No. 5,609,212.

An additional shortcoming of the standard fire sprinkler system in buildings and warehouses which have a peaked roof is also related to the unavailability in other than 90° and 45° (135°) elbow fittings. The roof peak of a sloped roof will necessarily have a correspondingly angled peak angle which will virtually certainly not match either of the standard elbows available. Due to this shortcoming in pipe fitting elbow availability, the interconnection between the upper ends of the upwardly sloping roof feed lines are left unconnected and terminate just short of the roof peak. This necessarily creates what may be referred to as a "tree system" wherein each of the main feed water supply lines provide water only to the feed lines extending upwardly on one of the roof panels while a second main water feed line provides water to be fed into the parallel array of feed lines attached to the other roof panel. Because the feed lines are dead ended or form a "tree system" the main water supply line must be of larger size and therefore more expensive in order to provide the required minimum level of water pressure and volume to the sprinkler heads when the system is energized in an emergency.

BRIEF SUMMARY OF THE INVENTION

This invention is directed to a building inside fire extinguishing system, the building having a standard roof pitch and corresponding peak angle. The system including a main water supply line extending along the base or lower margin of the roof and having spaced parallel upright pipe nipples attached to the main water supply line, a plurality of feed lines extending upwardly from the main water supply line parallel to the roof and a plurality of spaced water sprinkler heads operably attached to each of the feed lines. To interconnect the upper end of each upright nipple, an array of roof slope sprinkler fittings is provided, one of which is selected angularly matching the roof pitch. These sprinkler fittings each include an angled hollow body having a female threaded inlet and a female threaded outlet angularly oriented at different standard roof pitch angles one of which will equal the standard pitch of the roof. Each fitting is threadable directly to and between the pipe nipple and a lower end of the feed line. A separate array of roof peak fittings connecting the upper ends of each pair of aligned feed lines may also be provided.

It is therefore an object of this invention to provide a more economical means facilitating the installation of a building inside fire extinguishing system.

Yet another object of this invention is to provide an array of elbow-type fittings which are angled between the female threaded portions at angles which match the standard roof pitch of such building roof installations.

Still another object of this invention is to provide an array of roof slope and roof pitch water fittings which greatly facilitate and reduce the number of components necessary to interconnect the main water supply lines and the water feed lines attached to sprinklers of a building fire extinguishing system.

And another object of this invention is to improve water flow and reduce pipe sizing by providing a grid system for a fire extinguishing system of a building.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
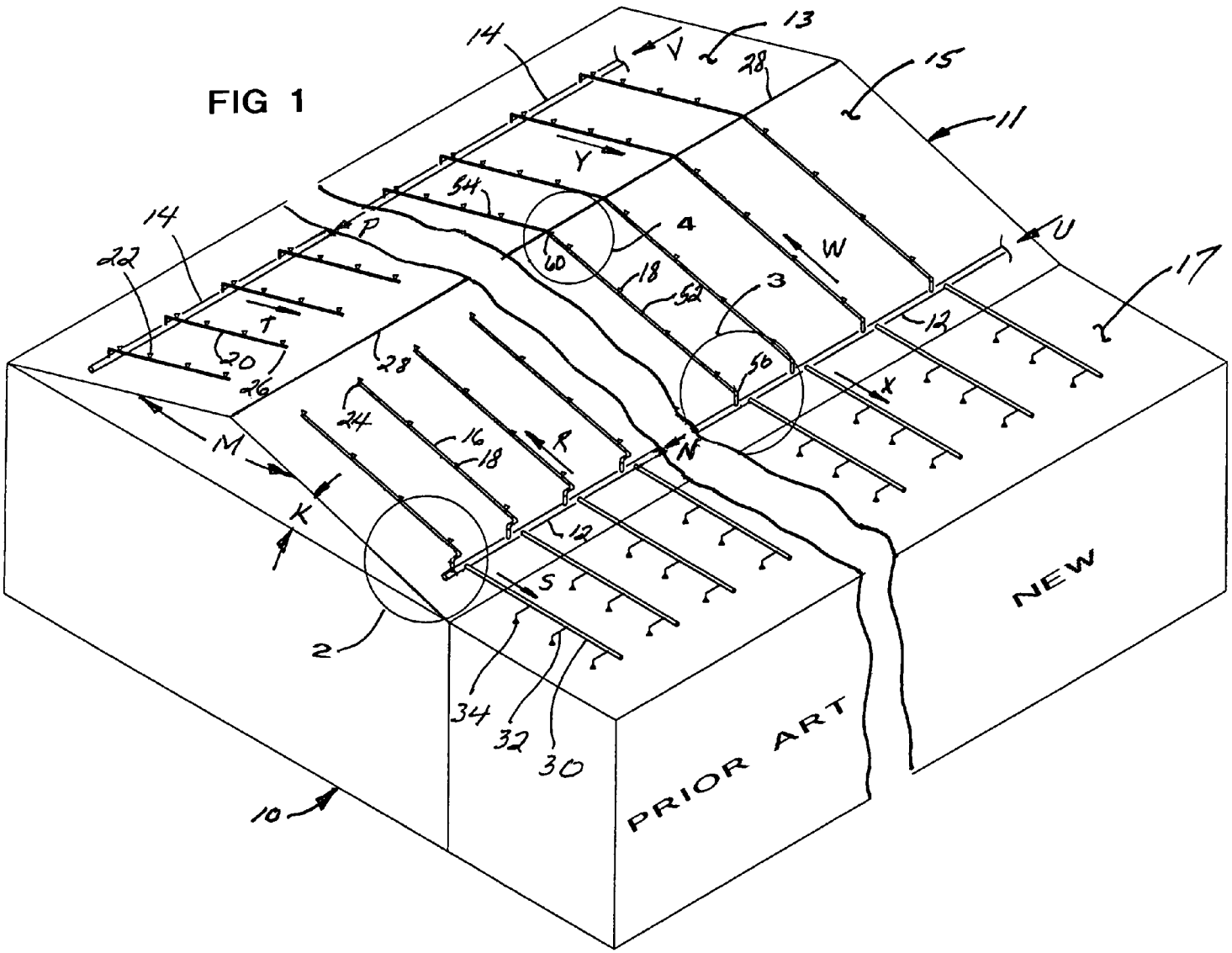
FIG. 1 is a perspective broken view of a typical peaked roof building, the front half of which depicts a typical prior art fire extinguishing system while the rear half of the building depicts the present invention.

Referring now to the drawings, and firstly to FIG. 1, a typical building or warehouse is shown generally at numeral 10 including a peaked roof shown generally at numeral 11 having roof panels 13 and 15 connected together along a peak 28. The building 10 will also include a horizontal roof section 17 which is typically over air conditioned offices.

A typical fire extinguishing system found in prior art as labeled in FIG. 1 includes elongated main water supply lines 12 and 14 which extend along and in close alignment and adjacent to the lower margins of each of the roof panels 13 and 15. Each of these main water supply lines 12 and 14 are connected to a supply of water (not shown) such as from a well or a municipality water system, the water flowing in the direction of arrows N and P, respectively. The prior art fire extinguishing system also includes a plurality of spaced parallel upwardly sloping water feed lines 16 and 20, each of which have spaced sprinkler heads 18 and 22 operably attached thereto for dispersing fire quenching water downwardly therefrom.

Each of these feed lines 16 and 20 are required to be positioned in close proximity to the inside surface of each of the roof panels 13 and 15 and in general parallel relationship thereto. Each of the roof panels 13 and 15 are oriented at a roof pitch angle K, those standard pitch angles being 1:12, 2:12, 3:12, 4:12, 5:12 and 6:12. Pitch angles above the standard 6:12 are rare as these buildings are fabricated of steel structural members for greater strength.

Separate horizontally oriented water feed lines 20 extend horizontally and in parallel fashion as shown from the main water supply line 12 to provide fire sprinkler 34 coverage from nipples 32 through the feed line 30 in the direction of arrow S. Because the feed lines 30 are connected in orthogonal relationship to the main water supply line 12, the array of unique elbow-type fittings of the present invention are not applicable to this aspect of the invention.

Figure 2:
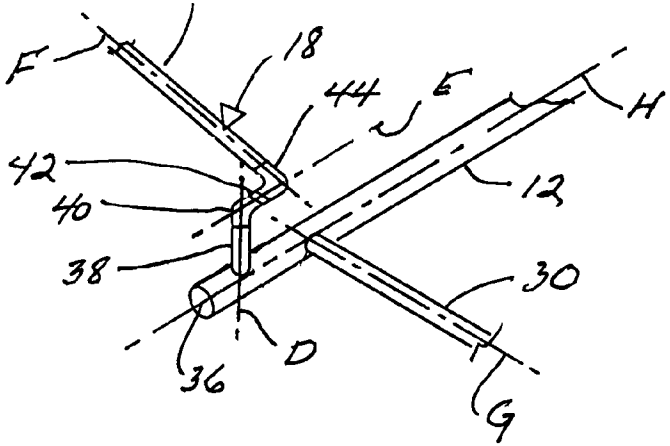
FIG 2 (PRIOR ART)
FIG. 2 is an enlarged perspective view of area 2 in FIG. 1.

Referring in more detail to FIG. 2, the drawback of the prior art installation arrangement is, in one aspect, there shown. The axis F of each of the feed lines 16 must be oriented at an angle K, the roof pitch angle. To accomplish a fluid communication transition, an upright nipple 38 is first threadably engaged into the main water supply line 12 about upright axis D. Thereafter, a first 90° elbow 40 is threadably engaged onto this male threaded nipple 38. A second male threaded short nipple 42 is then threadably engaged into female threaded elbow 40, after which a second female threaded 90° elbow 44 is threaded onto the other end of threaded nipple 42. Finally, the male threaded feed line 16 is threadably engaged into the other female threaded end of elbow 44 whereupon the exact roof pitch angle K may easily be established by rotatably adjusting each of the feed lines 16 into parallel relationship with the roof panel 15.

The second previously described drawback of this prior art arrangement is encountered in the inability to economically connect the upper distal ends 24 and 26 of each of the feed lines 16 and 20 together. This difficulty is encountered because the roof peak angle M, which is complementary to the roof pitch angle K, is almost universally substantially greater than 90° or 135°, the standard elbow fitting angles currently available. To overcome this defect in elbow angle availability, a U-shaped prior art arrangement may be implemented which again requires a total of four 90° elbows and three short male nipple fittings to effect a V-shaped connection between these distal ends 24 and 26. As a result, the typical prior art installation as previously described is in the form of a "tree system" with the inherent drawbacks again previously described.

Figure 3:
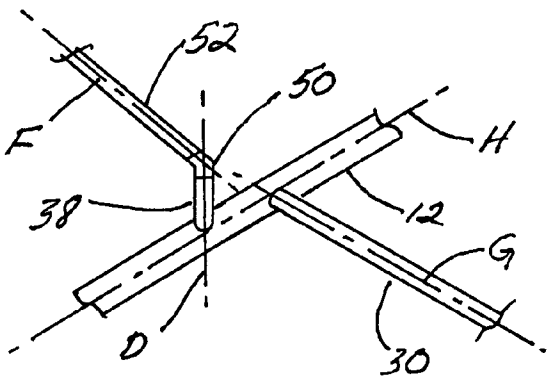
FIG. 3 is an enlarged perspective view of area 3 in FIG. 1.
Figure 4:
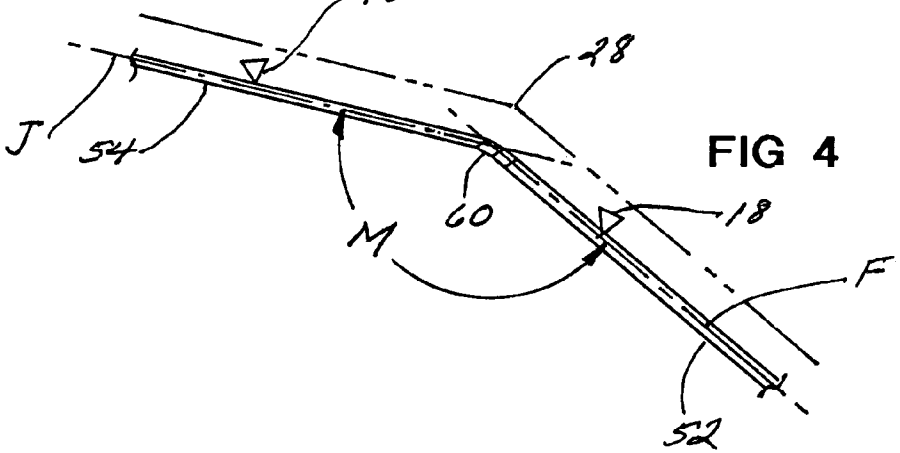
FIG. 4 is an enlarged perspective view of area 4 of FIG. 1.
Figure 5:
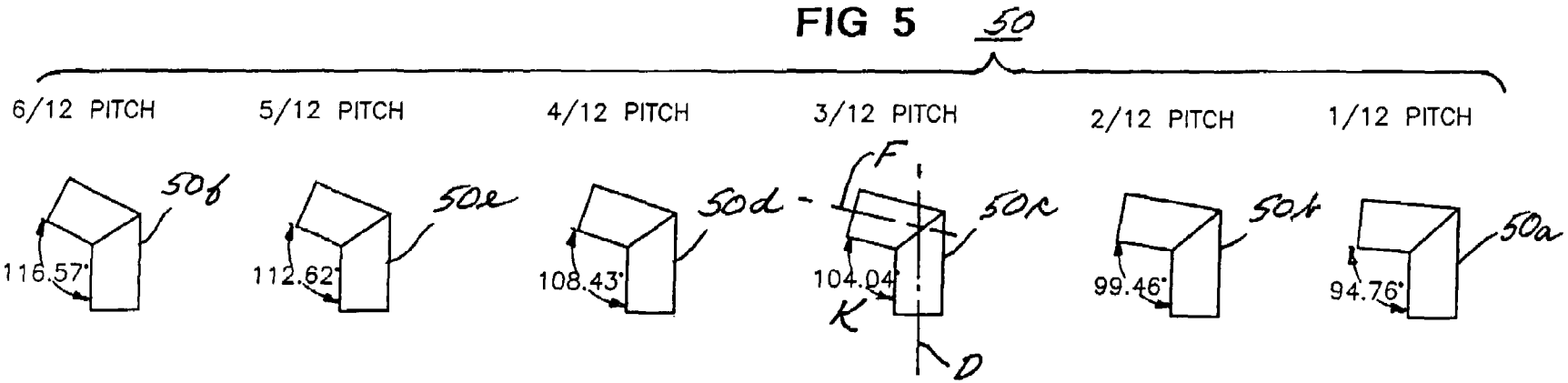
FIG. 5 is a side elevation schematic view of an array of standard roof pitch angle sprinkler fittings.

Referring additionally now to FIGS. 3, 4 and 5, the present invention overcomes the above limitations of the prior art systems by providing an array of roof pitch sprinkler fittings shown generally at numeral 50 in FIG. 5. This array of fittings includes female threaded elbows 50*a*, 50*b*, 50*c*, 50*d*, 50*e*, and 50*f* having a roof pitch angle generally shown as angle K between axis D and axis F. These roof pitch fittings have angle K established to be equal to a roof pitch of 1:12, 2:12, 3:12, 4:12, 5:12 and 6:12. Again, roof pitch angles above 6:12 are rare in building structures.

As best seen in FIG. 3, the main water supply line 12 is taped into by upwardly extending male threaded nipples 38, after which one of the sprinkler fittings 50*a* to 50*f* are selected which matches the exact pitch of the roof panels 13 and 15. This particularly selected sprinkler fitting 50 is then threadably engaged onto the upper end of nipple 38, aligned orthogonally upwardly toward the peak 28, after which the feed line 52 is threadably engaged into the other end of the sprinkler fitting 50. Because the selected fitting 50 exactly matches the pitch of the roof, only the one fitting is required in the transition from the upward nipple 38 and the feed line 52.

Figure 6:
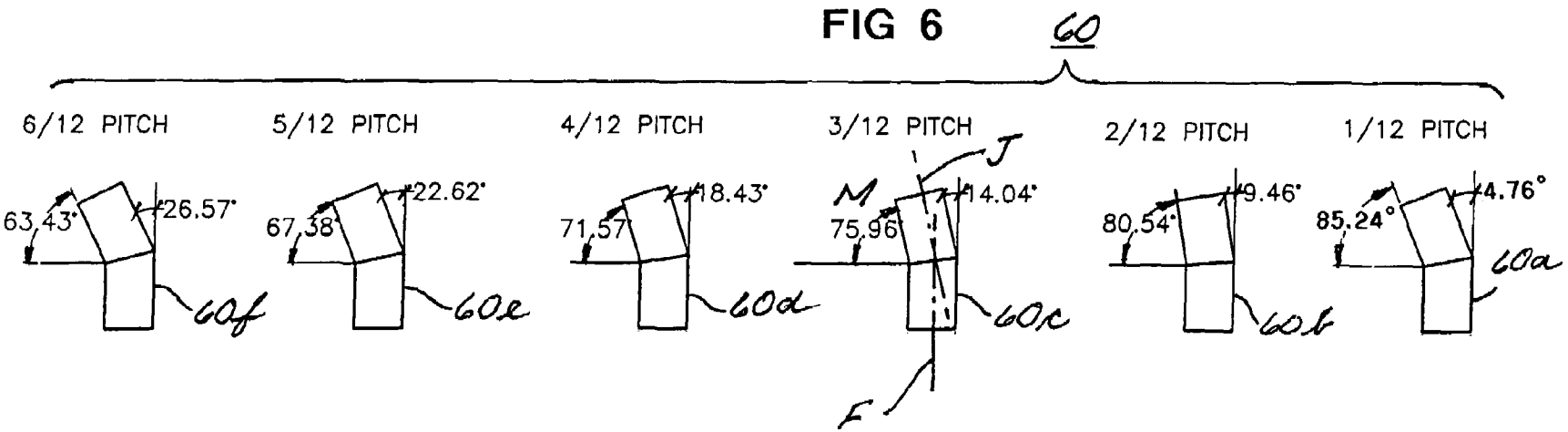
FIG. 6 is a side elevation view of an array of standard roof peak angle sprinkler fittings.

An additional important aspect of the invention is to provide a separate array of roof peak fittings shown in FIG. 6 generally at numeral 60. Each of these roof peak fittings are shown generally at 60*a*, 60*b*, 60*c*, 60*d*, 60*e*, and 60*f* and have the female portions thereof oriented between axes F and J at a roof peak angle M as also shown in FIGS. 1 and 4. As best seen in FIG. 4, the properly selected roof peak fitting 60*a* through 60*f*, having a roof peak angle M which matches the roof peak angle of the roof 11, facilitates direct connection between the upper male threaded ends of the aligned feed lines 52 and 54. By this arrangement, a grid system shown as the new invention in FIG. 1 is thus facilitated wherein water under pressure may be supplied in the direction of both U and V into the corresponding main water supply lines 12 and 14 then transversely up the corresponding feed lines in the direction of W and Y, and also in the direction of arrow X through the horizontal feed lines 30. The new grid system arrangement greatly improves the water flow characteristics of the sprinkler heads 18 and facilitates the use of smaller diameter pipe and tubing sizes for each element of the fire extinguishing system itself.

Figure 7:
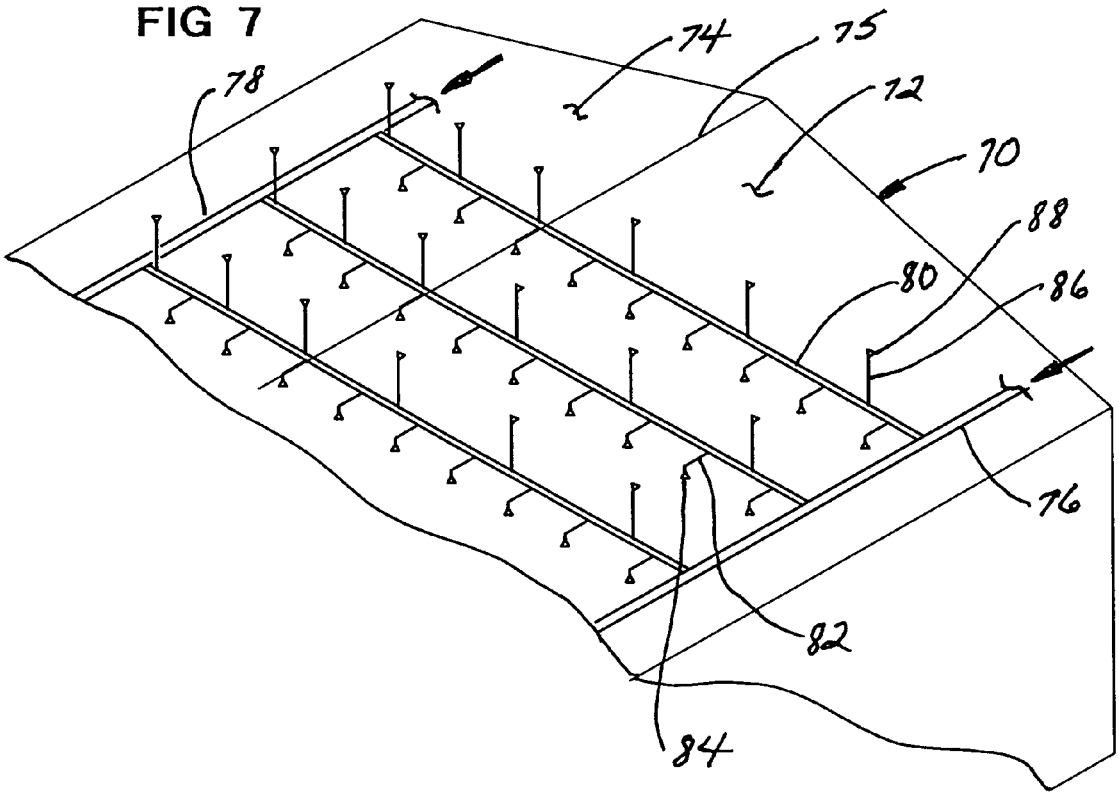
FIG. 7 is a perspective broken view of a peaked roof building showing another fire extinguishing system with the addition of the present invention.
Figure 8:
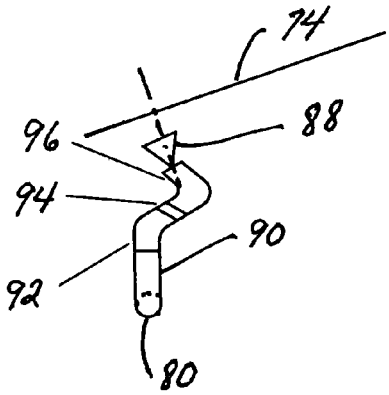
FIG 8 (PRIOR ART)
FIG. 8 is an enlarged perspective view of a typical prior art sprinkler head termination arrangement.
Figure 9:
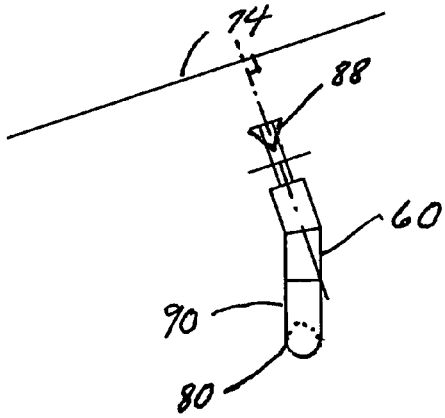
FIG. 9 is an enlarged perspective view of the sprinkler termination arrangement of the present invention.

Referring now to FIGS. 7 to 9, another typical building or warehouse is shown generally at numeral 70 and includes a peaked roof including roof panels 72 and 74 connected together along peak 75. Another typical fire extinguishing system arrangement includes two elongated main supply lines 76 and 78 which extend along and in close alignment with and adjacent to the lower margins of each of the roof panels 72 and 74 in a manner previously described in FIG. 1. Each of these main water supply lines 76 and 78 are connected to a supply of water (not shown).

In this fire extinguishing system, a plurality of spaced parallel horizontal water feed lines 80 which receive water under pressure at each end thereof in a grid system as previously described with respect to FIG. 1. This new grid system arrangement greatly improves water flow characteristics of the sprinkler heads 88.

Each of the sprinkler heads 88 which upwardly extend on an upwardly extending riser 86 must be oriented to spray perpendicular to the roof panels 72 or 74. In a conventional prior art arrangement for accomplishing this sprinkler head orientation is shown in FIG. 8 wherein a short riser 90 is attached and upwardly extends from the feed line 80 into a 90° elbow 92. A short nipple 94 is required to connect a second 900 elbow 96 thereto whereupon the angular adjustment of the sprinkler head 88 may be then adjustably rotated to be orthogonal to the roof panel 74.

In FIG. 9 the simplicity of the present invention is there shown to accomplish the same orthogonal orientation of the sprinkler head to the roof panel 74 with a simple addition of one of the roof peak fittings 60 which is selected from an array of roof peak fittings as previously described based upon the normal pitch of the roof panel 74.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A building inside fire extinguishing system, the building having a sloped roof of standard pitch, the system including a main water supply line extending along the base of the roof and having a plurality of spaced parallel upright pipe nipples attached in fluid communication with the main water supply line, a plurality of feed lines extending upwardly from the main water supply line parallel to the roof and a plurality of spaced water sprinkler heads operably attached to each of the feed lines, the building inside fire extinguishing system comprising:

an array of sprinkler fittings each including an angled hollow body having a female threaded inlet and a female threaded outlet angularly oriented one to another at a different standard roof pitch angle, one said angle equal to the standard pitch of the roof;

each said fitting threadable directly to and between the upper end of the pipe nipple and a lower end of the feed line;

an array of roof peak fittings each including an angled hollow body having a female threaded inlet and a female threaded outlet angularly oriented one to another at a different standard roof peak angle, one said roof peak angle equal to the standard roof peak angle of the roof;

each said roof peak fitting threadable directly to and between an upper end of each pair of end-to-end aligned feed lines.

2. The array inside fire extinguishing system as set forth in claim 1, wherein:

said standard roof pitches are 1:12, 2:12, 3:12, 4:12, 5:12 and 6:12.

3. An array of fire extinguishing system sprinkler fittings for installation directly between an upright pipe nipple connected to an elongated main water feed line and a pipe feed line extending in parallel spaced relation to a sloped roof of a building, each of said array of sprinkler fittings comprising:

an angled hollow body having a female threaded inlet and a female threaded outlet, said threaded inlet and outlet angularly oriented one to another at a different standard roof pitch angle, one said angle equal to the standard pitch of the roof;

each said fitting threadable directly to and between the pipe nipple and a lower end of the feed line;

an array of roof peak fittings each including an angled hollow body having a female threaded inlet and a female threaded outlet angularly oriented one to another at a different standard roof peak angle, one said roof peak angle equal to the standard roof peak angle of the roof;

each said roof peak fitting threadable directly to and between an upper end of each pair of end-to-end aligned feed lines.

4. The array of fire extinguishing system sprinkler fittings as set forth in claim 3, wherein:

said standard roof pitches are 1:12, 2:12, 3:12, 4:12, 5:12 and 6:12.

5. A fire extinguisher system for the interior of a building having a peaked roof, the roof sloping upwardly to the peak at a standard roof pitch and having a corresponding standard roof peak angle, said system comprising:

a main water supply line extending along a base or lower margin of each sloping roof panel and having a plurality of spaced parallel upright pipe nipples attached in fluid communication with the main water supply line;

a plurality of feed lines extending upwardly from each main water supply line parallel to the inside of each roof panel and including a plurality of spaced water sprinkler heads operably attached to each of said feed lines;

an array of roof slope fittings each including an angled hollow body having a female threaded inlet and a female threaded outlet angularly oriented one to another at one of the standard roof pitch angles, one said roof pitch angle equal to the standard pitch of the roof;

each of said roof slope fittings threadable directly to and between the pipe nipple and a lower end of the feed line;

an array of roof peak fittings each including an angled hollow body having a female threaded inlet and a female threaded outlet angularly oriented one to another at a different standard roof peak angle, one said roof peak angle equal to the standard roof peak angle of the roof;

each said roof peak fitting threadable directly to and between an upper end of each pair of end-to-end aligned feed lines.

6. The fire extinguishing system as set forth in claim 5, wherein:

said standard roof pitches are 1:12, 2:12, 3:12, 4:12, 5:12 and 6:12;

said standard roof peak angles corresponding to said standard roof pitch angles are 85.24°, 80.54°, 75.96°, 71.57°, 67.38° and 63.43°, respectively.

7. A building inside fire extinguishing system, the building having a sloped roof of standard pitch, the system including a main water supply line extending along the base of the roof and having a plurality of spaced parallel feed lines extending horizontally from the main water supply line with a plurality of spaced upright pipe nipples attached in fluid communication with the main water supply line and a plurality of spaced water sprinkler heads operably attached to each of the pipe nipples, the building inside fire extinguishing system comprising:

an array of roof peak fittings each including an angled hollow body having a female threaded inlet and a female threaded outlet angularly oriented one to another at a different standard roof peak angle, one said angle equal to the standard peak of the roof;

each said fitting threadable directly to and between the upper end of one of the pipe nipple and one sprinkler head whereby each of the sprinkler heads are oriented orthogonally to the slope of the roof.

8. The building inside fire extinguishing system as set forth in claim 7, wherein:

said standard roof pitches are 1:12, 2:12, 3:12, 4:12, 5:12 and 6:12.

* * * * *